US008387507B2

(12) United States Patent
Johnson et al.

(10) Patent No.: US 8,387,507 B2
(45) Date of Patent: Mar. 5, 2013

(54) WEAPON INTERCEPTOR PROJECTILE WITH DEPLOYABLE FRAME AND NET

(75) Inventors: Michael R. Johnson, Tucson, AZ (US); Garrett L. Hall, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 1241 days.

(21) Appl. No.: 12/189,294

(22) Filed: Aug. 11, 2008

(65) Prior Publication Data

US 2012/0211595 A1 Aug. 23, 2012

(51) Int. Cl.
*F41H 11/00* (2006.01)
*F41H 13/00* (2006.01)

(52) U.S. Cl. ..... 89/1.1; 89/902

(58) Field of Classification Search ..... None
See application file for complete search history.

(56) References Cited

U.S. PATENT DOCUMENTS

| | | | | | |
|---|---|---|---|---|---|
| 1,211,001 | A | | 1/1917 | Steinmetz | |
| 1,247,331 | A | | 11/1917 | Robinson | |
| 1,274,419 | A | | 8/1918 | Jackson | |
| 1,536,164 | A | | 5/1925 | Tainton | |
| 2,296,980 | A | * | 9/1942 | Carmichael | 102/504 |
| 2,308,683 | A | | 1/1943 | Forbes | |
| 2,322,624 | A | | 6/1943 | Forbes | |
| 4,090,567 | A | * | 5/1978 | Tomlinson | 169/53 |
| 4,142,696 | A | * | 3/1979 | Nottingham | 244/3.16 |
| 4,193,567 | A | * | 3/1980 | McCarty, Jr. | 244/3.16 |
| 4,833,995 | A | * | 5/1989 | Gotz et al. | 102/521 |
| 5,583,311 | A | * | 12/1996 | Rieger | 89/1.11 |
| 6,079,398 | A | * | 6/2000 | Grimm | 124/16 |
| 6,220,918 | B1 | * | 4/2001 | Laronge | 446/63 |
| 6,382,105 | B1 | * | 5/2002 | Jones | 102/370 |
| 6,454,623 | B1 | * | 9/2002 | Flatau | 446/34 |
| 6,959,893 | B1 | * | 11/2005 | Sadowski et al. | 244/3.16 |
| 7,190,304 | B1 | | 3/2007 | Carlson | |
| 7,202,809 | B1 | | 4/2007 | Schade et al. | |
| 7,412,916 | B2 | * | 8/2008 | Lloyd | 89/1.11 |
| 7,415,917 | B2 | * | 8/2008 | Lloyd | 102/473 |
| 8,122,810 | B2 | * | 2/2012 | Glasson | 89/1.11 |
| 2005/0016372 | A1 | * | 1/2005 | Kilvert | 89/1.34 |

(Continued)

OTHER PUBLICATIONS

Versatile Explosives, Airbag Chemistry, Summer 2003, Los Alamos National Laboratory: http://www.lanl.gov/quarterly/q_sum03/chemistry.shtml.*

(Continued)

*Primary Examiner* — Bret Hayes
*Assistant Examiner* — Joshua Freeman
(74) *Attorney, Agent, or Firm* — Renner, Otto, Boisselle & Sklar, LLP

(57) ABSTRACT

A weapon interceptor projectile has a deployable frame for maintaining a deployable net in shape. The deployable frame may be an inflatable structure, including a flexible material inflated by a gas generator. The inflatable structure has a perimeter that supports an outside shape of the net, and a series of spokes or arms that couple the perimeter to a body of the projectile. The perimeter may have an airfoil cross-section shape, reducing drag of the frame and aiding in deployment. The perimeter may be have a circular shape, giving the net a circular area. The deployable frame allows the net to maintain its shape during flight, increasing its area and its ability to come into contact with an incoming weapon, such as a rocket propelled grenade (RPG).

20 Claims, 3 Drawing Sheets

U.S. PATENT DOCUMENTS

| | | | | |
|---|---|---|---|---|
| 2005/0132923 | A1* | 6/2005 | Lloyd | 102/477 |
| 2005/0183615 | A1* | 8/2005 | Flatau | 102/503 |
| 2006/0112817 | A1* | 6/2006 | Lloyd | 89/1.11 |
| 2006/0225598 | A1* | 10/2006 | Okamoto et al. | 102/218 |
| 2007/0079819 | A1* | 4/2007 | Vanek et al. | 124/16 |
| 2007/0180983 | A1* | 8/2007 | Farinella et al. | 89/36.07 |
| 2009/0266226 | A1* | 10/2009 | Beach et al. | 89/36.02 |
| 2010/0307328 | A1* | 12/2010 | Hoadley et al. | 89/36.02 |
| 2012/0011996 | A1* | 1/2012 | Glasson | 89/36.17 |

OTHER PUBLICATIONS

"Force Protection Systems", Pacific Scientific Energetic Materials Company, [retrieved online], <http://www.psemc.com/force_protection.htm>.

"IABS—RPG Active Countermeasure", IABS RPG Countermeasure, (2002-2006), [retrieved online], <http://www.defence-update.com/products/i/IABS.htm>.

Related U.S. Appl. No. 12/189,299, filed Aug. 11, 2008.

Related U.S. Appl. No. 12/189,302, filed Aug. 11, 2008.

* cited by examiner

WEAPON INTERCEPTOR PROJECTILE WITH DEPLOYABLE FRAME AND NET

BACKGROUND OF THE INVENTION

1. Technical Field of the Invention

The invention is in the field of projection systems to protect devices from incoming flying weapons.

2. Description of the Related Art

Rocket propelled grenades (RPGs) are examples of a type of projectile that poses a great threat to ground vehicles and helicopters. RPGs are commonly used during close-in military engagements, where the shooter and the target are close to one another. Defeating an incoming RPG with a fragmentation warhead interceptor may destroy the incoming RPG, but may also in the process produce an omni-directional pressure wave and a shower of fragments. These fragments may injure personnel or cause damage, such as by causing damage to a helicopter or ground vehicle that is being fired upon. From the foregoing it will be appreciated that it may be desirable to have improved ways of dealing with incoming projectiles.

SUMMARY OF THE INVENTION

A weapon interceptor projectile includes deployable frame that supports a deployable net or mesh, maintaining coverage of the net or mesh over a substantially constant area. The deployable frame can be an inflatable structure, for example inflated by using a gas generator consisting of air bag propellant pellets. The inflatable structure may include a perimeter, such as a ring, supported by multiple spokes that attach the perimeter to a central body of the projectile. The perimeter may have an airfoil shape that provides lift that laterally expands the perimeter away from the central axis of the projectile. The spokes may be a series of inflatable members extending radially out from the central body, substantially evenly circumferentially spaced about the perimeter. The net or mesh may be attached to the perimeter at attachment points substantially corresponding to a center of lift of the airfoil of the perimeter. The inflatable structure may consist of an outer net expansion nacelle with an airfoil cross-section, and several central support struts. The support struts are attached to a central distribution plenum that contains the net or mesh prior to deployment. The deployable structure provides a way to rapidly deploy and maintain the net or mesh over a predetermined area. Continued attachment of the central projectile body to the deployable frame provides additional momentum when the net or mesh impacts an incoming airborne weapon. The lack of an interceptor warhead for defeating the incoming weapon eliminates the need for any electromechanical warhead safe and arm subsystem, and reduces the possibility of fratricide or unwanted collateral damage. The projectile may include a propulsion module that rapidly deploys the projectile at a desired angle, so as to intercept an incoming weapon. The projectile may be able to intercept incoming weapons over a full range of angles, with interception occurring at a desired stand-off distance. Use of proven automotive air bag technology provides a projectile that has high reliability, high durability, no moving parts, low cost, and low risk.

According to an aspect of the invention, a weapon interceptor projectile includes a deployable frame that supports a deployable net or mesh.

According to another aspect of the invention, a weapon interceptor projectile includes an inflatable frame inflated using pressurized gases from a gas generator, for example using propellant pellets ignited by an electrical igniter.

According to yet another aspect of the invention, a weapon interceptor projectile includes an inflatable frame for supporting a net or mesh, wherein the frame fractures a frangible casing when inflated.

According to still another aspect of the invention, a weapon interceptor projectile includes a deployable frame that has a perimeter with an airfoil shape, providing lift in a radial direction away from a central axis of the profile, in order to facilitate deployment of the frame and reduce aerodynamic drag of the structure in flight. A net or mesh may be attached to the perimeter, such as at or near a center of lift on the airfoil shape.

According to a further aspect of the invention, a weapon interceptor projectile includes: a body; a deployable net inside the body; and a deployable frame attached to the net. The net and the frame are configured to deploy such that the frame maintains the net in a shape.

According to still another aspect of the invention, a method of intercepting an incoming projectile includes the steps of: deploying a frame and a net of an interceptor projectile, wherein the net is attached to the frame such that the frame, when deployed, maintains a fixed shape; and after the deploying, intercepting the incoming projectile with the net.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

In the annexed drawings, which are not necessarily to scale.

DETAILED DESCRIPTION

A weapon interceptor projectile has a deployable frame for maintaining a deployable net in shape. The deployable frame may be an inflatable structure, including a flexible material inflated by a gas generator. The inflatable structure has a perimeter that supports an outside shape of the net, and a series of spokes or arms that couple the perimeter to a body of the projectile. The perimeter may have an airfoil cross-section shape, reducing drag of the frame and aiding in deployment. The perimeter may be have a circular shape, giving the net a circular area. The deployable frame allows the net to maintain its shape during flight, increasing its area and its ability to come into contact with an incoming weapon, such as a rocket propelled grenade (RPG).

Figure 1:
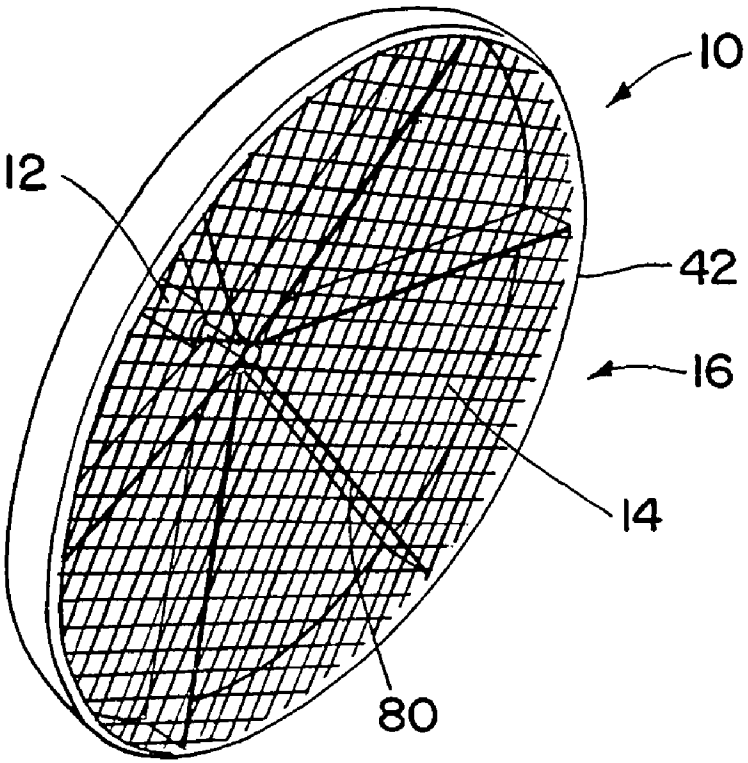
FIG. 1 is an oblique view of a weapon interceptor projectile, in a deployed configuration, in accordance with an embodiment of the invention.
Figure 2:
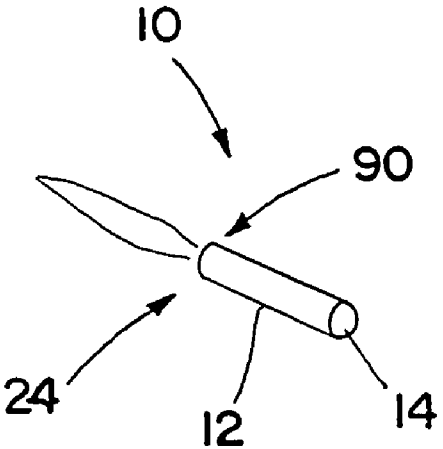
FIG. 2 is an oblique view showing the weapon interceptor projectile of FIG. 1, in a stowed configuration, prior to deployment.
Figure 3:
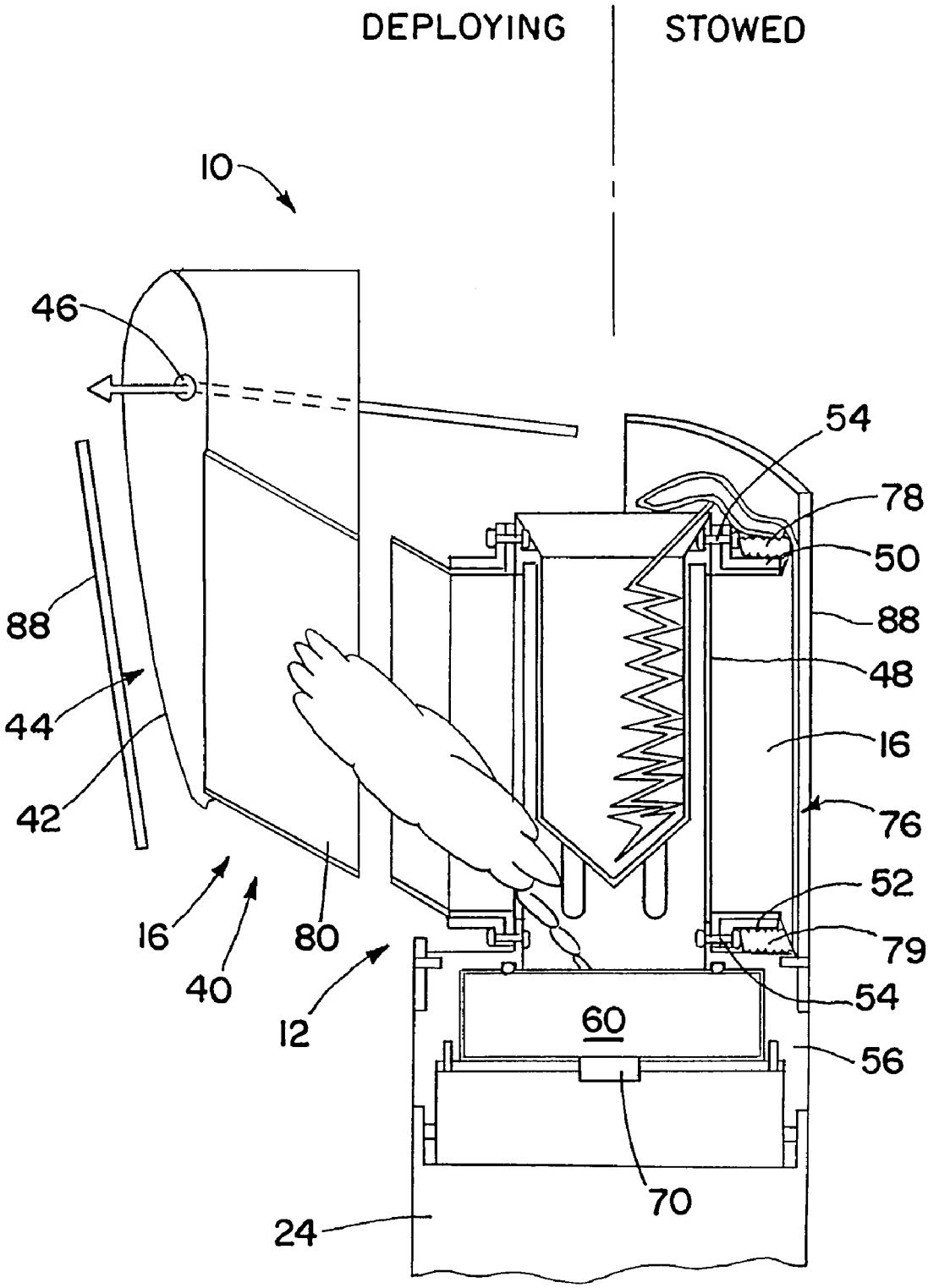
FIG. 3 is a cross-sectional view illustrating both the stowed and deploying configurations of the weapon interceptor projectile of FIG. 1.

Referring initially to FIGS. 1-3, a weapon interceptor projectile 10 includes a body 12 that initially houses a deployable net 14 and a deployable frame 16. The net 14 and the frame 16 deploy as shown in FIG. 1 to provide a large area for contact with an incoming weapon, such as a rocket propelled grenade (RPG) or a mortar round. The frame 16 provides a way to keep the net 14 in a desired shape, allowing the deployed net 14 to sweep out a large area and impact an incoming weapon over that large area. FIG. 1 shows the projectile 10 in a deployed state, with the net 14 and the frame 16 deployed. FIG. 2 shows the same projectile prior to deployment. A nose cap 20 covers the front of the projectile body 12, with the net 14 and the frame 16 within the body 12. The projectile 10 includes a propulsion module 24 that is aft of the net 14 and the frame 16. The propulsion module 24 uses pressurized gases, such as are produced by combustion, to propel the projectile 10.

FIG. 3 shows further details regarding both the deployed configuration of the projectile 10, and the configuration of the projectile 10 prior to deployment of the net 14 and the frame 16. The left side of FIG. 3 illustrates the deployed condition, and the right side of FIG. 3 illustrates the stowed condition prior to deployment.

A net module 28 houses and deploys the net 14 and the frame 16. The net 14 is initially located in a central distribution plenum 30 that is at the center of the projectile body 12. The distribution plenum 30 has a forward-facing opening 32 out of which the net 14 emerges when deployed. The plenum 30 may have an angled opening, with a mouth that widens toward the forward-facing opening 32. This may facilitate deploying the net radially outward from the center of the body 12.

Net ends 34 are attached at attachment points 38 to an inflatable structure 40 that serves as the deployable frame 14. The attachment points are at points of a perimeter or nacelle 42 of the inflatable structure 40 that provides an outer frame of the inflatable structure 40. The perimeter 42 may be an airfoil 44 that provides lift to expand and maintain the perimeter 42 radially outward away from an axis or center line of the body 12. The attachment points 38 may substantially coincide with points along a center of lift 46 of the airfoil 44.

The plenum 30 is surrounded by an inner cylinder 48. A pair of retention flanges 50 and 52 are all attached to the inner cylinder using a series of fasteners 54, such as a series of rivets. Trapped between the inner cylinder 48 and the flanges 50 and 52 are portions of the inflatable structure 40. The fasteners 54 are used to anchor these portions of the inflatable structure 40, to maintain attachment between the body 12 and the inflatable structure 40, even after deployment of the inflatable structure 40.

The lower retention flange 52 is also attached to a base 56 of the body 12. The base 56 encloses a gas generator 60 that is used to generate pressurized gases 64 for inflating the inflatable structure 40. The gas generator 60 may be the same as the material used for generating gases for the operation of automotive air bags, for example pellets containing a mixture of $NaN_3$, $KNO_3$ and $SiO_2$. An igniter 70 is used to ignite the gas generator 60.

The gas generator 60 may have about 25 grams of combustible material. This may be on the order of half of the mass of explosive material used in a projectile that utilizes a high explosive material. It will be appreciated that it is advantageous from a safety and handling standpoint that no high explosive material is required in the projectile 10. For example there is no need for safe and arm electromechanical lockouts in the projectile 10.

The inflation of the inflatable structure 40 may provide containment for substantially all the pressurized gases produced by the gas generator 60. The structure 40 itself may provide containment for and may attenuate pressure rates produced by the combustion of the material of the gas generator 60.

The inflatable structure 40 is located in a pocket 76 between the retention flanges 50 and 52, and also is initially accordion folded around the retention flanges 50 and 52. These accordion folded regions are indicated at 78 and 79 in FIG. 3.

The base 56 is also attached to the propulsion module 24. Various interior parts of the body 12, such as the base 56, the inner cylinder 48, the plenum 30, and the retention flanges 50 and 52, may be made of any of a variety of suitable metals, such as steel and aluminum. The inflatable structure 40 may be made of a suitable lightweight flexible material, such as nylon or suitable plastic material.

With reference to FIG. 1, the inflatable structure 40 has a series of spokes or arms (or struts) 80 that maintain a connection between the body 12 and the perimeter 42. The spokes or arms 80 are inflated and expand along with the inflation of the perimeter 42. The spokes or arms 80 may have any of a variety of streamline shapes, in order to minimize drag. It will be appreciated that there is no general advantage in having the spokes or arms 80 able to generate lift. Also, it will be appreciated that the perimeter 42 may have a variety of other cross-sectional shapes, which need not necessarily be lift generating. However, it is desirable that the shapes for the perimeter 42 and the spokes or arms 80 be such that the inflatable structure 40 has low drag.

In the stowed configuration the inflatable structure 40 is surrounded and enclosed by a frangible casing 88. The frangible may be made of a suitable plastic material. The casing 88 is configured to break into pieces as the inflatable structure 40 deploys by moving outward. The casing 88 may be configured such that the pieces are small enough to minimize collateral damage.

There may be four or more side thrust motors 90 on the propulsion module 24. Operation of side thrust motors may be used to orient the projectile 10 as desired. A control system may be used to set the desired orientation of the projectile 10, and the timing of initiating combustion of the gas generator 60 by firing the igniter 70, prior to launch of the projectile 10.

Figure 4:
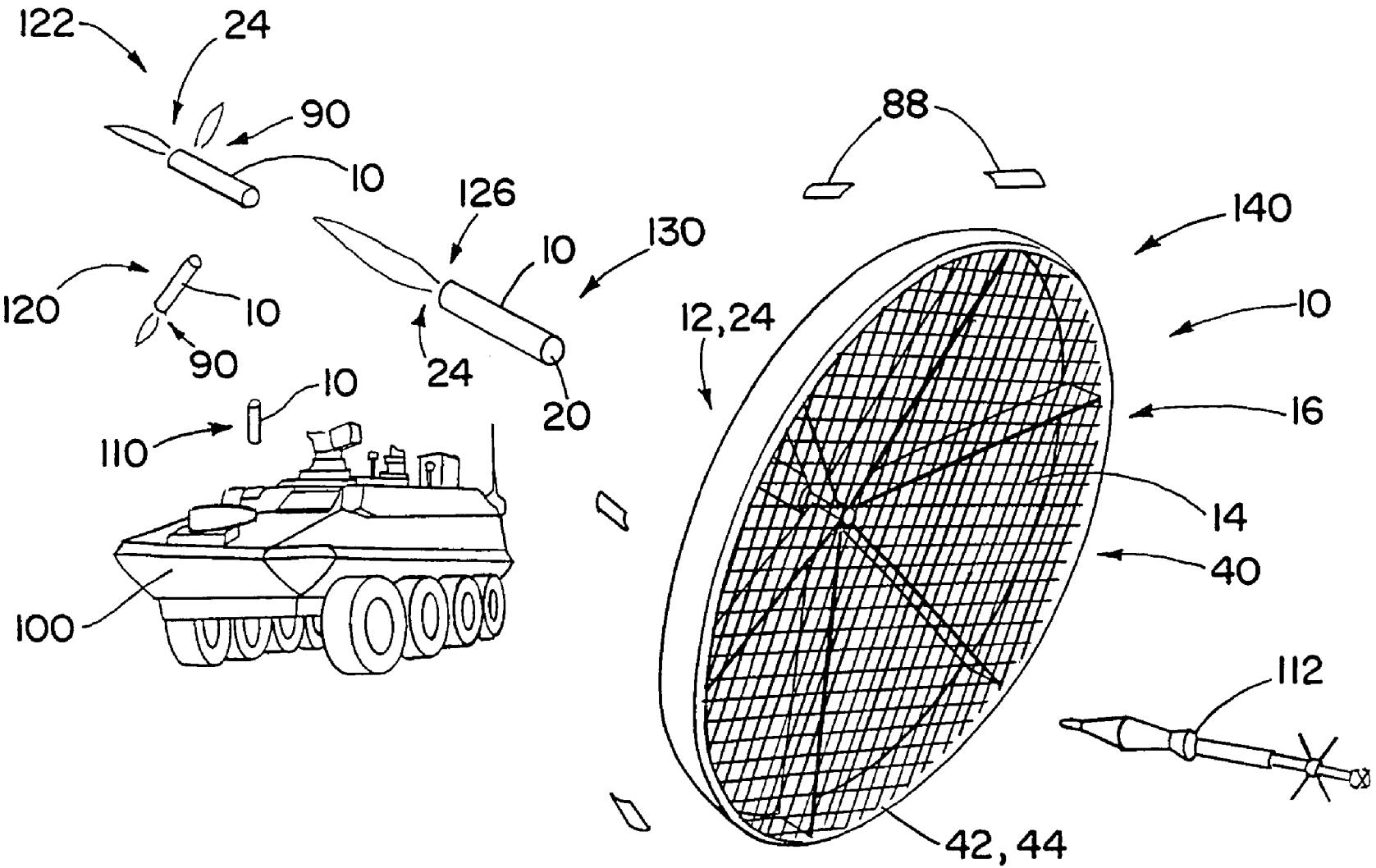
FIG. 4 is a schematic view illustrating various steps in the operation of the weapon interceptor projectile of FIG. 1.

FIG. 4 shows the launch and deployment process of the interceptor 10. The initially ejection of the projectile 10 from a vehicle 100 is shown at 110. The vehicle 100 is shown as a ground vehicle in the figure. However, it will be appreciated that the vehicle may be another sort of vehicle, for example an air vehicle such as a helicopter. When ejected the projectile 10 will already have an intercept course predetermined for intercepting an incoming weapon 112. Also, the projectile 10 may be configured for deploying the net 14 and the frame 16 at a predetermined time, in order to have the net 14 and frame 16 deployed just before reaching the weapon 112. This may be done by sending timing information for firing of the gas generator 60 (FIG. 3) at an appropriate interval after launch.

Side thrusting motors 90 of the propulsion module 24 are used to pitch and point the projectile as shown at reference numbers 120 and 122. Following the achievement of proper orientation of the projectile 10, the main thrust motor 126 of the propulsion module 24 is fired in a boost phase 130.

Finally, a net 14 and the frame 16 are deployed, as indicated at reference number 140. This deployment is initiated by firing of the igniter 70 (FIG. 3) to initiate combustion within the gas generator 60 (FIG. 3). The gas is generated by this combustion are used to fill the inflatable structure 40. Outward pressure from the structure 40 breaks the frangible casing 88, and drives the nose cap 20 away from the projectile 10. The airfoil 44 on the perimeter 42 of the structure 40 may provide lift forces that aid in fully spreading or deploying the inflatable structure 40.

Once the net 14 and the frame 16 are deployed the interceptor 10 is ready for its collision with the incoming weapon 112. A weapon 112 collides with the net or mesh 14, and/or with the frame 16. This collision may drive the weapon 112 off course. Alternatively or in addition the collision may cause damage to portions of the weapon 112 so as to disable the weapon 112. For example the collision may cause short-circuiting of a liner to a housing of the weapon 112, which may result in the weapon 112 becoming incapable of exploding. It will be appreciated that it is advantageous to retain the net 14 and the frame 16 mechanically coupled to the body 12 and the propulsion module 24. This provides additional momentum as the projectile collides with the incoming weapon 112. The additional momentum increases the amount of course diversion in the weapon 112. In addition, the increased momentum increases the amount of damage caused to the weapon 112, for example increasing the likelihood of short-circuiting a liner of the weapon 112. The perimeter 42 may have a diameter of about 2 meters when fully deployed. Thus the projectile 10 may have an effective diameter of about 2 meters for intercepting the incoming weapon 112.

The net or mesh 14 may be made of a variety of suitable materials, for example a fiber material such as KEVLAR.

It will be appreciated that the perimeter 42 may be in shapes other than circular. For example the perimeter 42 may alternatively have a square, other rectangular, octagonal, other polygonal, or other suitable shape. The inflatable structure 40 may optionally include structural members for strengthening parts of the structure 40, and maintaining a desired shape.

The projectile 10 has a number of advantageous characteristics relative to certain prior interceptors. Since no explosives are used in intercepting and defeating an incoming weapon, there is a reduction in the possibility of unwanted damage to nearby structures and personnel, for example ground personnel or structure and crew of an air vehicle that fires the projectile 10. The projectile 10 utilizes a number of proven technologies, provided a higher reliability, low cost, and low risk system for intercepting and defeating the incoming weapon 112. In conjunction with this advantage, the projectile 10 advantageously does not utilize any moving parts. Another advantage is the projectile may be able to intercept incoming weapons at substantially any incoming angle. Since the frame 16 supports the deployed net 14, there may be a greater margin of error in the timing of net deployment, since the net 14 remains at its fully deployed area, rather than perhaps collapsing again after initial deployment.

The lack of a warhead or other explosive in the projectile 10 dispenses with any need for safety measures associated with explosives, such as safe and arm subsystems. The projectile 10 may also be lighter than systems that require a relatively heavy explosive and fragmentation package to defeat an incoming weapon.

The frame 16 has been described above in terms of the inflatable structure 40 (FIG. 1). However, it will be appreciated that other sorts of deployable frames may be utilized. For example lightweight solid materials such as aluminum or plastic may be used as parts of a deployable frame to provide structure to all or a part of the net 14 (FIG. 1). Such an alternative structure may be tethered to the body 12, for example using nylon, KEVLAR, or other high strength material thread or weave. As another alternative the net 14 itself may be tethered to the body 12.

The projectile 10 may be used for other purposes than intercepting weapons. Other sorts of objects may be intercepted using the projectile 10. It will be appreciated that a variety of sizes may be used for the area covered by the net 14 and surrounded by the perimeter or nacelle 42 for other parts of a deployable frame.

The continuing attachment of the deployable frame 16 to the body 12, even after deployment, may advantageously dispense with any need for providing separate weights to the net 14 or the deployable frame 16.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A weapon interceptor projectile comprising:

a body;

a deployable net inside the body; and a deployable frame attached to the net;

wherein the net and the frame are configured to deploy such that the frame maintains the net in a shape; and wherein, prior to deployment, the net is located in a central distribution plenum of the body that is at a radial center of the body, with a longitudinal axis of the body passing through the central distribution plenum.

2. The weapon interceptor projectile of claim 1, wherein the frame is an inflatable frame that deploys by inflation.

3. The weapon interceptor projectile of claim 2, further comprising a gas generator in the body, wherein the gas generator generates pressurized gas for inflating the inflatable frame.

4. The weapon interceptor projectile of claim 3, further comprising an electrical igniter that is operatively coupled to the gas generator to ignite the gas generator.

5. The weapon interceptor projectile of claim 3, wherein the gas generator includes $NaN_3$, $KNO_3$ and $SiO_2$.

6. The weapon interceptor projectile of claim 1, wherein the frame is attached to the body, even after deployment of the frame and the net.

7. The weapon interceptor projectile of claim 6, wherein the frame includes a nacelle around a perimeter of the frame, and arms attached to both the nacelle and the body.

8. The weapon interceptor projectile of claim 7, wherein the net is attached to the nacelle.

9. The weapon interceptor projectile of claim 1, wherein the frame is circular.

10. The weapon interceptor projectile of claim 1, further comprising a cylindrical frangible casing that initially surrounds the frame, the net, and the central distribution plenum of the body;

wherein the frangible case breaks as the frame deploys.

11. The weapon interceptor projectile of claim 10, wherein the deployable frame is folded in a passage that is surrounded by the frangible casing.

12. The weapon interceptor projectile of claim 1, further comprising a propulsion module coupled to the body;

wherein the propulsion module includes side thrust motors for changing flight direction of the interceptor projectile.

13. A weapon interceptor projectile comprising:

a body; a deployable net inside the body; and a deployable frame attached to the net;

wherein the net and the frame are configured to deploy such that the frame maintains the net in a shape; wherein the frame is directly attached to the body, even after the deployment of the frame and the net; wherein the frame includes a nacelle around a perimeter of the frame, and arms attached to both the nacelle and the body; and wherein the nacelle has an airfoil shape that creates lift in a direction away from the body, to aid in deployment of the frame.

14. The weapon interceptor projectile of claim 13, wherein the net is attached is to the nacelle substantially at a center of lift of the nacelle.

15. A method of intercepting an incoming projectile, the method comprising: deploying a frame and a net of an interceptor projectile, wherein the net is attached to the frame such that the frame, when deployed, maintains a fixed shape; and after the deploying, intercepting the incoming projectile with the net; wherein the deploying includes a perimeter of the frame generating lift in radial directions away from a body of the interceptor projectile; wherein the deploying includes the frame directly attached to the body, even after deployment of the frame and net.

16. The method of claim 15, wherein the deploying includes maintaining attachment between the frame and a body of the interceptor projectile.

17. The method of claim 15, further comprising, prior to the deploying, directing the interceptor projectile toward the incoming projectile using side thrust motors of a propulsion system of the interceptor projectile.

18. The method of claim 15, wherein the deploying includes inflating the frame.

19. The method of claim 15, wherein the perimeter of the frame has an airfoil shape; and wherein the frame includes spokes attached to both the perimeter and the body.

20. The method of claim 19, wherein the net is attached to the perimeter.

* * * * *